US010262649B1

(12) United States Patent
Cheng et al.

(10) Patent No.: US 10,262,649 B1
(45) Date of Patent: Apr. 16, 2019

(54) NOISE CANCELLATION DEVICE AND NOISE CANCELLATION METHOD

(71) Applicants: Inventec (Pudong) Technology Corporation, Shanghai (CN); INVENTEC CORPORATION, Taipei (TW)

(72) Inventors: Yi-Lun Cheng, Taipei (TW); Chih-Kai Yang, Taipei (TW); Kuo-Chi Ting, Taipei (TW)

(73) Assignees: Inventec (Pudong) Technology Corporation, Shanghai (CN); INVENTEC CORPORATION, Taipei (TW)

( * ) Notice: Subject to any disclaimer, the term of this patent is extended or adjusted under 35 U.S.C. 154(b) by 0 days.

(21) Appl. No.: 15/862,610

(22) Filed: Jan. 4, 2018

(30) Foreign Application Priority Data

Oct. 10, 2017 (CN) ..... 2017 1 0934682

(51) Int. Cl.
*G10K 11/178* (2006.01)
*H04R 1/28* (2006.01)

(52) U.S. Cl.
CPC ..... *G10K 11/178* (2013.01); *H04R 1/2873* (2013.01); *G10K 2210/505* (2013.01)

(58) Field of Classification Search
CPC ..... G10K 11/178; G10K 11/17873; G10K 11/17833; G10K 11/17854; G10K 2210/1081; G10K 2210/3016; G10K 2210/3027; G10K 2210/3028; G10K 2210/3226; G10K 2210/3219; G10K 2210/505; H04R 1/2873
See application file for complete search history.

(56) References Cited

U.S. PATENT DOCUMENTS 9,276,541 B1 * 3/2016 Froment ..... H03G 3/32
2004/0234080 A1 * 11/2004 Hernandez ..... G10K 11/178 381/71.11
2006/0285697 A1 * 12/2006 Nishikawa ..... G10K 11/178 381/71.1
2014/0270225 A1 * 9/2014 Gether ..... G10K 11/178 381/71.6

* cited by examiner

*Primary Examiner* — Jason R Kurr
(74) *Attorney, Agent, or Firm* — CKC & Partners Co., LLC

(57) ABSTRACT

A noise cancellation device includes a voice receiving module, a distance measuring module, a noise cancellation module and a speaker module. The voice receiving module is configured to receive a noise. The distance measuring module is configured to send a distance measuring signal to an object, and calculate distance information of the object according to a reflected distance measuring signal reflected by the object. The noise cancellation module is connected to the voice receiving module and the distance measuring module, and is configured to generate a reverse phase signal of the noise according to the noise. The speaker module is connected to the noise cancellation module, and is configured to generate an anti-noise according the reverse phase signal, and sound the anti-noise according to the distance information.

6 Claims, 4 Drawing Sheets

NOISE CANCELLATION DEVICE AND NOISE CANCELLATION METHOD

RELATED APPLICATIONS

This application claims priority to Chinese Application Serial Number 201710934682.7, filed Oct. 10, 2017, which is herein incorporated by reference.

BACKGROUND

Field of Invention

The present invention relates to a noise cancellation device and a noise cancellation method. More particularly, the present invention relates to a noise cancellation device and a noise cancellation method with an active noise cancellation function.

Description of Related Art

In general, when a user uses a notebook in a noisy environment, it is inevitable that the user is affected by noise to be distracted, and a general improvement way is that the user wears earplugs or earphones to block the noise. However, if the user wears the earplugs or the earphones for a long time, it causes to another persecution instead.

SUMMARY

The invention provides a noise cancellation device and a noise cancellation method.

The noise cancellation device of the present disclosure includes a voice receiving module, a distance measuring module, a noise cancellation module and a speaker module. The voice receiving module is configured to receive a noise. The distance measuring module is configured to send a distance measuring signal to an object, and calculate distance information of the object according to a reflected distance measuring signal reflected by the object. The noise cancellation module is connected to the voice receiving module and the distance measuring module, and is configured to generate a reverse phase signal of the noise according to the noise. The speaker module is connected to the noise cancellation module, and is configured to generate an anti-noise according the reverse phase signal, and sound the anti-noise according to the distance information.

The noise cancellation method of the present disclosure applies to the noise cancellation device. The noise cancellation method includes a step of receiving a noise by a voice receiving module, a step of sending a distance measuring signal to an object, and calculating distance information of the object according to a reflected distance measuring signal reflected by the object by a distance measuring module, a step of generating a reverse signal of the noise according to the noise by a noise cancellation module and a step of generating an anti-noise according the reverse noise, and sounding the anti-noise according to the distance information by a speaker module.

In summary, the noise cancellation device and the noise cancellation method of the present disclosure form the noise reduction area at the position of the user's ears by the voice receiving module, the distance measuring module, the noise cancellation module and the speaker module, and the noise reduction area would move with the user. Thereby, when the user uses the noise cancellation device in a noisy environment, due to the noise generated from external environment has been offset by the anti-noise generated by the speaker module. Therefore, the user can't be affected by the noise to be distracted, and the mechanism of the anti-noise can't cause to persecution.

BRIEF DESCRIPTION OF THE DRAWINGS

In order to more clearly illustrate the above and other object, features, advantages and embodiments of the present disclosure, the accompany drawings are as follows.

DETAILED DESCRIPTION

The following is cited embodiments accompanied with figures are described in detail, but the examples are not provided to limit the scope of the invention covered by the non-operation of the structure described in order to limit its implementation, any by the structure regrouping of the components, the device has equal efficacy to produce, it is all covered by the scope of the present invention.

The terms "comprise," "comprising," "include," etc. used in this specification are open-ended and mean "comprises but not limited."

In the terms (Terms) specification and claims the whole article is used, unless otherwise specified, each word having generally used in this field, the disclosure herein and the specific content usually significance. Certain terms used to describe elsewhere in the present disclosure will be or under discussion in this specification, those skilled in the art to provide additional guidance in describing the present disclosure related.

Figure 1:
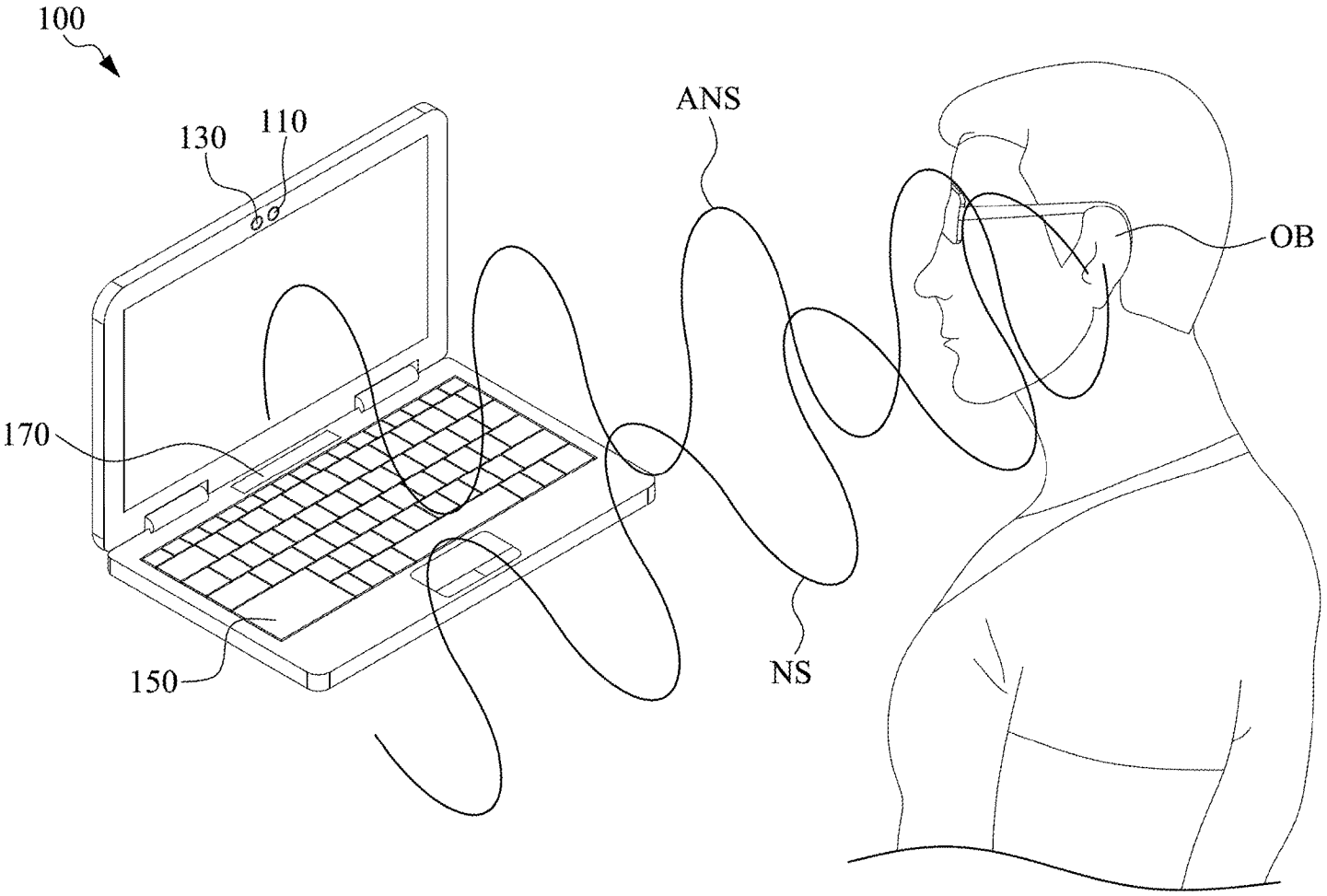
FIG. 1 is a schematic diagram of a noise cancellation device and an object in accordance with some embodiments of the present disclosure.
Figure 2:
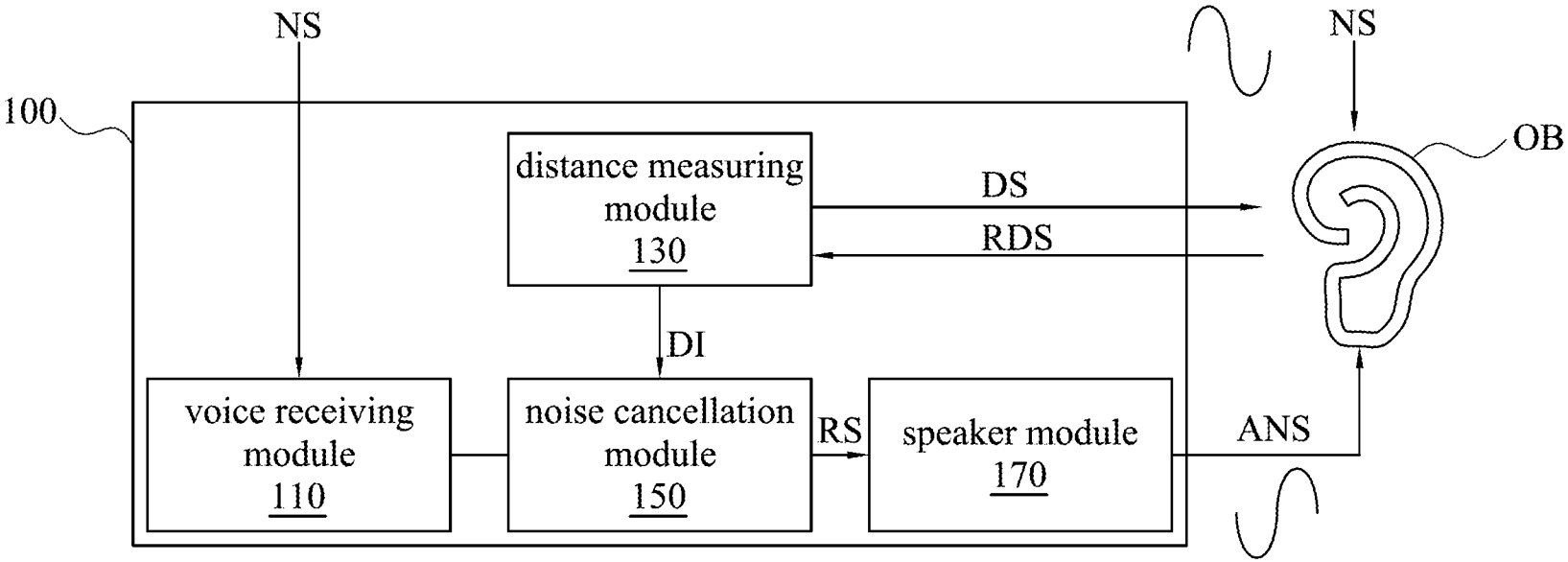
FIG. 2 is a block diagram of a noise cancellation device and an object in accordance with some embodiments of the present disclosure.

References are now made to FIG. 1 and FIG. 2. FIG. 1 is a schematic diagram of a noise cancellation device 100 and an object OB in accordance with some embodiments of the present disclosure. FIG. 2 is a block diagram of the noise cancellation device 100 and the object OB in accordance with some embodiments of the present disclosure.

The noise cancellation device 100 includes a voice receiving module 110, a distance measuring module 130, a noise cancellation module 150 and a speaker module 170.

The noise cancellation module 150 is connected to the voice receiving module 110, the distance measuring module 130 and the speaker module 170.

In some embodiments, the noise cancellation device 100 is taken a notebook as an example, but this disclosure is not limited thereto. Devices that are similar to the notebook are within a scope of this disclosure, such as All-in One PC (AIO) or smart phone.

In some embodiments, the voice receiving module 110 is taken a microphone as an example, the distance measuring module 130 is taken an infrared distance meter, the noise cancellation module 150 is taken as active noise cancellation (ANC) as an example, and the speaker module 170 is taken as a speaker as an example, but this disclosure is not limited thereto.

In some embodiments, the object OB is taken an ear as an example.

Figure 3:
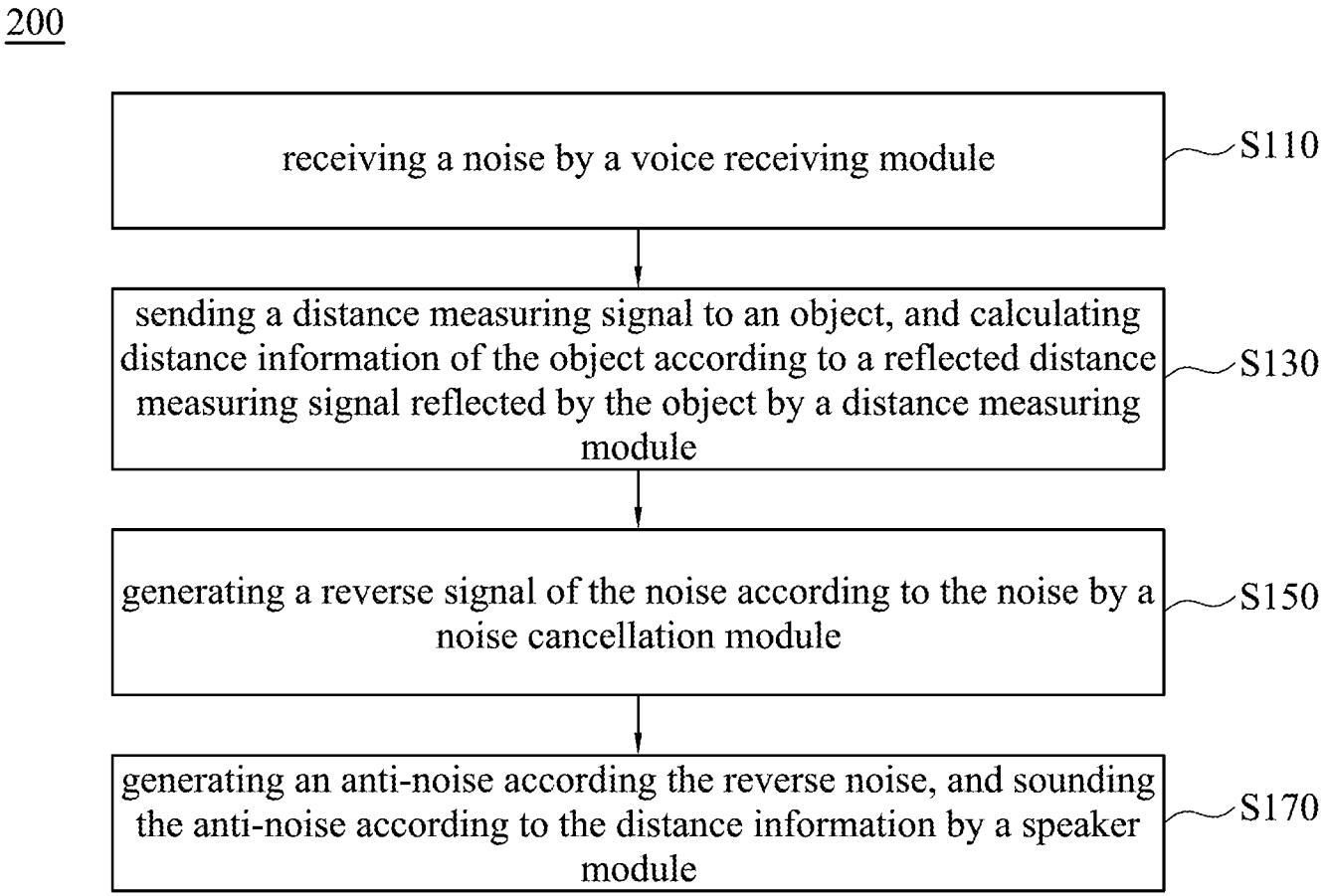
FIG. 3 is a flow chart of a noise cancellation method in accordance with some embodiments of the present disclosure.

References are now made to FIG. 1 to FIG. 3. FIG. 3 is a flow chart of a noise cancellation method 200 in accordance with some embodiments of the present disclosure. The noise cancellation method 200 of FIG. 3 may apply to the noise cancellation device 100 of FIG. 1 and FIG. 2 to implement.

In step S110, the voice receiving module 110 may receive a noise NS generated from external environment, such as voice of chat or sound of crashed objects.

In step S130, the distance measuring module 130 may send a distance measuring signal DS to the object OB, and calculate distance information DI of the object OB according to a reflected distance measuring signal RDS reflected by the object OB.

In some embodiments, the distance measuring signal DS is taken infrared rays as an example.

Figure 4:
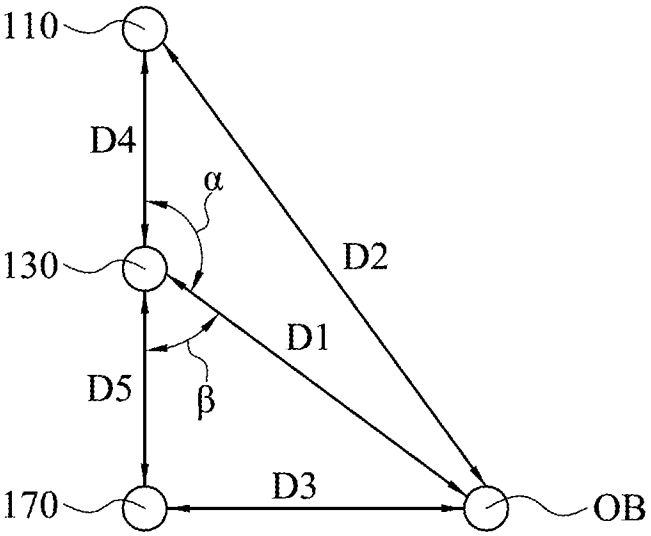
FIG. 4 is a schematic diagram of distance information in accordance with some embodiments of the present disclosure.

Further, reference of detailed description about the distance information DI is made to FIG. 4, and FIG. 4 is a schematic diagram of the distance information DI in accordance with some embodiments of the present disclosure.

First of all, a configuration of the voice receiving module 110, the distance measuring module 130, the speaker module 170 and the object OB is shown as FIG. 4, and the configuration is just an example, but this disclosure is not limited thereto.

Then, distances of between the voice receiving module 110, the distance measuring module 130, the speaker module 170 and the object OB are further defined, that is a first distance D1, a second distance D2, a third distance D3, a fourth distance D4 and a fifth distance D5. The first distance D1 is a distance between the object OB and the distance measuring module 130. The second distance D2 is a distance between the object OB and the voice receiving module 110. The third distance D3 is a distance between the object OB and the speaker module 170. The fourth distance D4 is a distance between the distance measuring module 130 and the voice receiving module 110, and the fourth distance D4 is a known value. The fifth distance D5 is a distance between the distance measuring module 130 and the speaker module 170, and the fifth distance D5 is a known value.

The distance information D1 includes the first distance D1, the second distance D2 and the third distance D3.

The first distance D1 may be calculated by the distance measuring module 130. Specifically, the distance measuring module 130 sends the distance measuring signal DS to the object OB, and calculates the first distance D1 according to the reflected distance measuring signal RDS reflected by the object OB. In detail, the distance measuring module 130 includes timer (not shown). The timer is used to measure a period to calculate the first distance D1. The period is from the distance measuring signal DS is send through the distance measuring signal DS is received by the distance measuring module 130.

The second distance D2 is calculated by the distance measuring module 130 according to the first distance D1 and the fourth distance D4. In detail, the voice receiving module 110, the distance measuring module 130 and the object OB form three vertexes of a triangle. The first distance D1, the second distance D2 and the fourth distance D4 are lengths of three sides of the triangle, respectively.

After lengths of two sides of the triangle (i.e. the first distance D1 and the fourth distance D4) and a first included angle α between the two sides are calculated, length of a remaining side (i.e. the second distance D2) of the triangle can be calculated through the law of cosines of the trigonometric functions. That is, the first distance D1, the second distance D2, the fourth distance D4 and the first included angle α satisfy a following equation:

$$D2^2=D1^2+D4^2-2\times D1\times D4\times\cos(\alpha)$$

The third distance D3 is calculated by the distance measuring module 130 according to the first distance D1 and the fifth distance D5. In detail, the distance measuring module 130, the speaker module 170 and the object OB form three vertexes of a triangle. The first distance D1, the third distance D3 and the fifth distance D5 are lengths of three sides of the triangle, respectively.

After lengths of two sides of the triangle (i.e. the first distance D1 and the fifth distance D5) and a second included angle β between the two sides are calculated, length of a remaining side (i.e. the third distance D3) of the triangle can be calculated through the law of cosines of the trigonometric functions. That is, the first distance D1, the third distance D3, the fifth distance D5 and the second included angle β satisfy a following equation:

$$D3^2=D1^2+D5^2-2\times D1\times D5\times\cos(\beta)$$

In step S150, the noise cancellation module 150 generates a reverse signal RS of the noise NS according to the noise.

Specifically, when the voice receiving module 110 receives the noise NS, the noise cancellation module 150 analysis the noise NS, and then captures phase, frequency and amplitude of the noise NS.

In step S170, the speaker module 170 generates an anti-noise ANS according to the reverse signal RS, and sounds the anti-noise ANS according to the distance information DI.

Due to the second distance D2 and a sound speed are known values, the noise cancellation module 150 calculate the first time T1 that the object OB receives the noise NS.

The noise cancellation module 150 calculates time that when the noise cancellation module 150 generates the reverse signal RS of the noise NS according to the known third distance D3, the sound speed and the first time T1. Wherein the frequency and the amplitude of the reverse signal RS are the same as the frequency and the amplitude of the noise NS, and the phase difference between the phase of the reverse signal RS and the phase of the noise NS is 180 degree. In other words, the noise cancellation module 150 generated the second time T2 of the reverse signal RS according to the third distance D3 and the first time T1. The first time T1, the second time T2, the second distance D2 and the third distance D3 satisfy a following equation:

$$T2=\frac{D3}{D2}\times T1$$

Specially, when the noise cancellation module 150 generates the reverse signal RS at the second time T2, the speaker module 170 generates the anti-noise ANS. Wherein the frequency and the amplitude of the anti-noise ANS are the same as the frequency and the amplitude of the noise NS, and the phase difference between the phase of the anti-noise ANS and the phase of the noise NS is 180 degree.

Thereby, for the object OB, the object OB would receive the noise NS and the anti-noise ANS. Because the noise NS and the anti-noise ANS have the same frequency and amplitude, and their phase difference is 180 degree, sound wave of the noise NS and sound wave of the anti-noise ANS can cause destructive interference, and two sound waves would offset each other. At this time, a noise reduction area would form at position of the object OB, and the noise reduction area would move with the object OB.

An example of the first time T1 and the second time T2 are as follows.

First of all, assuming that a configuration of the voice receiving module 110, the distance measuring module 130, the speaker module 170 and the object OB is shown in FIG. 4, and the second distance D2 is two times as long as the third distance D3.

After the voice receiving module 110 receives the noise NS, the noise cancellation module 150 calculates the first time T1 (e.g. 2 seconds) that the object OB receives the noise NS according to the second distance D2.

Then, in order to form the noise reduction area at the position of the object OB, the object OB must receive the noise NS and the anti-noise ANS at the same time. The first time T1 that the object OB receives the noise NS is 2 seconds, and the second distance D2 is two times as long as the third distance D3. Due to the sound speeds of the noise NS and the anti-noise ANS are the same, when the second time T2 that the anti-noise ANS generated by the speaker module 170 is 1 second, the object OB receives the noise NS and the anti-noise ANS at the same time, and the noise reduction area forms at the position of the object OB, to achieve the purpose of cancelling the noise NS. It should be noted that values of the above first time T1 and second time T2 are examples, the values are not the actual values.

In summary, the noise cancellation device and the noise cancellation method of the present disclosure form the noise reduction area at the position of the user's ears by the voice receiving module, the distance measuring module, the noise cancellation module and the speaker module, and the noise reduction area would move with the user. Thereby, when the user uses the noise cancellation device in a noisy environment, due to the noise generated from external environment has been offset by the anti-noise generated by the speaker module. Therefore, the user can't be affected by the noise to be distracted, and the mechanism of the anti-noise can't cause to persecution.

Although the case has been described above in Example revealed, however it is not intended to limit the present case, any skilled in the art, without departing from the spirit and scope of the case, when available for a variety of modifications and variations, and therefore the case Depending on the scope of protection of the rights after the appended claims and their equivalents.

What is claimed is:

1. A noise cancellation device, comprising:

a voice receiving circuitry configured to receive a noise;

a distance measuring circuitry configured to send a distance measuring signal to an object, and calculate distance information of the object according to a reflected distance measuring signal reflected by the object;

a noise cancellation circuitry connected to the voice receiving circuitry and the distance measuring circuitry, and configured to generate a reverse phase signal of the noise according to the noise; and a speaker circuitry connected to the noise cancellation circuitry, and configured to generate an anti-noise according to the reverse phase signal, and sound the anti-noise according to the distance information;

wherein the distance information comprises a first distance between the object and the distance measuring circuitry, a second distance between the object and the voice receiving circuitry and a third distance between the object and the speaker circuitry, the noise cancellation circuitry calculates a first time that the noise transmits to the object according to the second distance and a sound speed, the noise cancellation circuitry calculates a second time that the noise cancelation module generates the reverse phase signal according to the third distance and the first time;

wherein the distance measuring circuitry is configured to calculate the second distance according to the first distance, a fourth distance and a first included angle, the distance measuring circuitry is configured to calculate the third distance according to the first distance, a fifth distance and a second included angle, the fourth distance is between the distance measuring circuitry and the voice receiving circuitry and the fifth distance is between the distance measuring circuitry and the object, the first included angle is between a side connected from the distance measuring circuitry to the object and a side connected from the distance measuring circuitry to the voice receiving circuitry, the second included angle is between the side connected from the distance measuring circuitry to the object and a side connected from the distance measuring circuitry to the speaker circuitry.

2. The noise cancellation device of claim 1, wherein the first time, the second time, the second distance and the third distance satisfy a following equation:

$$T2 = \frac{D3}{D2} \times T1,$$

wherein T1 represents the first time, T2 represents the second time, D2 represents the second distance and D3 represents the third distance.

3. The noise cancellation device of claim 1, wherein the first distance, the second distance, the third distance, the fourth distance, the fifth distance, the first included angle and the second included angle satisfy following equations:

$$D2^2 = D1^2 + D4^2 - 2 \times D1 \times D4 \times \cos(\alpha)$$

$$D3^2 = D1^2 + D5^2 - 2 \times D1 \times D5 \times \cos(\beta),$$

wherein D1 represents the first distance, D2 represents the second distance, D3 represents the third distance, D4 represents the fourth distance, D5 represents the fifth distance, $\alpha$ represents the first included angle, and $\beta$ represents the second included angle.

4. A noise cancellation method applied to a noise cancellation device, wherein the noise cancellation method comprising:

receiving a noise by a voice receiving circuitry;

sending a distance measuring signal to an object, and calculating distance information of the object according to a reflected distance measuring signal reflected by the object by a distance measuring circuitry;

generating a reverse phase signal of the noise according to the noise by a noise cancellation circuitry; and generating an anti-noise according to the distance information by a speaker circuitry;

wherein the distance information comprises a first distance between the object and the distance measuring circuitry, a second distance between the object and the voice receiving circuitry and a third distance between the object and the speaker circuitry, the noise cancellation circuitry calculates a first time that the noise transmits to the object according to the second distance and a sound speed, the noise cancellation circuitry calculates a second time that the noise cancelation module generates the reverse phase signal according to the third distance and the first time;

wherein the distance measuring circuitry is configured to calculate the second distance according to the first distance, a fourth distance and a first included angle, the distance measuring circuitry is configured to calculate the third distance according to the first distance, a fifth distance and a second included angle, the fourth distance is between the distance measuring circuitry and the voice receiving circuitry and the fifth distance is between the distance measuring circuitry and the object, the first included angle is between a side connected from the distance measuring circuitry to the object and a side connected from the distance measuring circuitry to the voice receiving circuitry, the second included angle is between the side connected from the distance measuring circuitry to the object and a side connected from the distance measuring circuitry to the speaker circuitry.

5. The noise cancellation method of claim 4, wherein the first time, the second time, the second distance and the third distance satisfy a following equation:

$$T2 = \frac{D3}{D2} \times T1,$$

wherein T1 represents the first time, T2 represents the second time, D2 represents the second distance and D3 represents the third distance.

6. The noise cancellation method of claim 4, wherein the first distance, the second distance, the third distance, the fourth distance, the fifth distance, the first included angle and the second included angle satisfy following equations:

$$D2^2 = D1^2 + D4^2 - 2 \times D1 \times D4 \times \cos(\alpha)$$

$$D3^2 = D1^2 + D5^2 - 2 \times D1 \times D5 \times \cos(\beta)$$

wherein D1 represents the first distance, D2 represents the second distance, D3 represents the third distance, D4 represents the fourth distance, D5 represents the fifth distance, $\alpha$ represents the first included angle, and $\beta$ represents the second included angle.

* * * * *